US008391443B2

(12) United States Patent
Brasile

(10) Patent No.: US 8,391,443 B2
(45) Date of Patent: Mar. 5, 2013

(54) COMPAC X-RAY SOURCE

(75) Inventor: Jean-Pierre Brasile, Gif sur Yvett (FR)

(73) Assignee: Thales, Neuilly sur Seine (FR)

( * ) Notice: Subject to any disclaimer, the term of this patent is extended or adjusted under 35 U.S.C. 154(b) by 203 days.

(21) Appl. No.: 12/975,135

(22) Filed: Dec. 21, 2010

(65) Prior Publication Data

US 2011/0268253 A1 Nov. 3, 2011

(30) Foreign Application Priority Data

Dec. 22, 2009 (FR) ..... 09 06260

(51) Int. Cl.
*H05G 2/00* (2006.01)

(52) U.S. Cl. ..... 378/119; 378/143

(58) Field of Classification Search ..... 378/119, 378/121, 143
See application file for complete search history.

(56) References Cited

U.S. PATENT DOCUMENTS 4,289,969 A 9/1981 Cooperstein et al.

FOREIGN PATENT DOCUMENTS

FR 2 783 127 A1 3/2000

OTHER PUBLICATIONS

A.A. Tishchenko et al., "X-ray transition radiation from an ultrarelativistic charge passing near the edge of a target or through a thin wire", Nuclear Instruments & Methods in Physics Research, Section—B:Beam Interactions With Materials and Atoms, Jan. 1, 2005, pp. 63-69, vol. 227, No. 1-2, Elsevier, Amsterdam , NL, XP004656921.

H. Yamada, "Novel X-ray source based on a tabletop synchrotron and its unique features", Nuclear Instruments & Methods in Phys Research, Section B:Beam Interactions With Materials and Atoms, Jan. 1, 2003, pp. 509-516, vol. 199, Elsevier, Amsterdam, NL, XP004403282.

*Primary Examiner* — Courtney Thomas
(74) *Attorney, Agent, or Firm* — Baker Hostetler LLP

(57) ABSTRACT

A compact device for generating X-rays by scattering includes a means for producing a beam of electrons, which comprises a grid of wires arranged in a useful scattering cone, so that the beam of electrons encounters at least one of the wires of the wire grid.

9 Claims, 3 Drawing Sheets

COMPAC X-RAY SOURCE

CROSS-REFERENCE TO RELATED APPLICATIONS

This application claims priority to foreign French patent application No. FR 09 06260, filed on Dec. 22, 2009, the disclosure of which is incorporated by reference in its entirety.

FIELD OF THE INVENTION

The subject of the present invention relates to a device and a method making it possible to provide a compact or small-dimension source of X-rays which comprises a set of wires or of means of interaction between electrons and the material constituting the wire or the means of interaction, the said interaction producing X-radiation.

In the subsequent description, the expression "useful scattering cone" will designate a cone whose aperture angle is determined according to the type of application and which defines a zone in which the electrons recovered after interaction on the wires are useful for constituting the X-ray beam.

BACKGROUND OF THE INVENTION

An important characteristic of X-radiation sources is brilliance, thus justifying for example the development of complex machines such as synchrotrons. The simplest way of producing X-radiation is obtained by Bremsstrahlung on the basis of a low-energy continuous electron beam. Unfortunately, a non-relativistic beam such as this interacts strongly with the anode of the device, thus giving rise to the production of X-rays at a large solid angle. The thermal problems associated with this interaction are solved by employing a revolving anode known from the prior art.

An improvement can also be afforded by focusing the beam on smaller zones, thus reducing the total flux of X-rays produced, but improving the brilliance since the source becomes more pointlike while improving the thermal budget. The radiation nonetheless remains poorly directional because of the low energy of the electrons.

Microcapillary techniques can retrieve the X-rays in a solid cone of the order of 10 mradians maximum and can increase, to some extent, the brilliance of such sources.

More sophisticated sources exist and are known from the prior art.

Thus, it is known to accelerate the electrons to several MeV before rotating them in a space where they interact with a wire. The advantages of this solution are three-fold since it offers:

- a source of small spatial dimension, representative of the size of the wire in one of its dimensions and a good thermal budget,
- good directivity due to the high energy of the electrons which focuses the electrons in a solid angle like $1/\gamma$ where $\gamma$ is the relativistic factor,
- good yield as regards total flux since the electrons that have not participated or have participated little in the interaction are recovered during the following revolutions.

Another device of the prior art is based on the same principle, but the wire is replaced with a packet of optical photons and the X-radiation is then produced by the inverse Compton effect. There is no longer any thermal constraint since the interaction occurs in vacuo, but it is necessary to recycle electrons and photons to obtain a good level of X-production because of the low yield of the interaction.

SUMMARY OF THE INVENTION

The idea implemented in the device according to the invention consists notably in causing a beam of electrons of good normalized emittance $\epsilon$ and of high energy characterized by the relativistic factor $\gamma$ to interact with a set of wire elements that will allow interaction with the electrons and that increase the probability of an electron encountering a wire. It can then be focused on a zone of $(\beta\epsilon/\gamma)^{0.5}$ where $\beta$ represents the contribution of the magnetic-focusing elements at an angle $(\epsilon/\beta\gamma)^{0.5}$. The idea implemented in the present patent application is to reuse the electrons which remain in the useful scattering cone after they have or have not interacted with the first wire arranged at the vertex of the scattering cone, since the probability that they will interact with other wires present in the useful scattering cone is not zero.

The invention relates to a compact device for generating X-rays by scattering comprising a means (I, II) for producing a beam of electrons, characterized in that it comprises a grid of wires arranged in a useful scattering cone, so that the electrons of the beam encounter at least one of the wires of the wire grid and produce X-radiation after interaction with the material.

The grid of wires consists, for example, of a set of wires arranged along an axis A1 and which are regularly distributed and spaced one and the same distance d apart on the said axis.

The useful scattering cone comprises several rows of wire which are arranged along several axes A1 . . . An.

The cross-section of the wires may be variable.

According to a variant embodiment, the wires are spaced apart by distances d1, d2, d3 whose values are decreasing.

The wires are, for example, mounted on supports allowing them to move so that an electron of the beam of electrons interacts with a different cross-section of the wire from the cross-section with which the temporally previous electron of the beam has interacted.

The movements of the wires can be in opposite directions for two collinear and contiguous wires.

The wire is made of a material chosen from among the following list: tungsten, copper, carbon, metal jet, microballs, or is formed partially by a plasma of the materials so as to form a monochromatic filter.

The device can comprise a retrieving optic arranged at the exit of the cross-section III of interaction of the electrons with the wire so as to increase the directivity of the beam.

BRIEF DESCRIPTION OF THE DRAWINGS

Other characteristics and advantages of the device according to the invention will be more apparent on reading the description which follows of a wholly non-limiting illustrative exemplary embodiment accompanied by the figures which represent.

DETAILED DESCRIPTION

Figure 1:
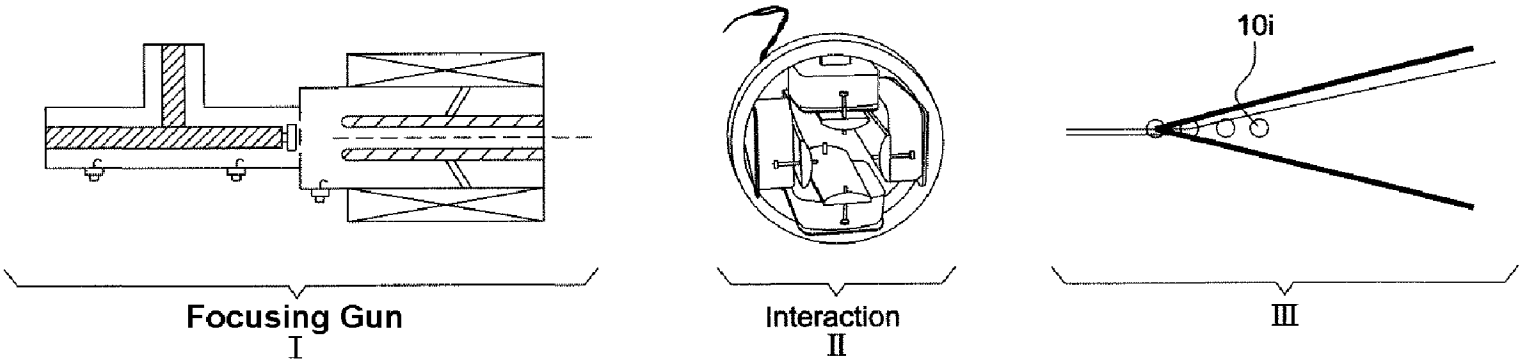
FIG. 1, an exemplary architecture of a compact device according to the invention, FIG. 2, the phenomenon of diffraction of the X-rays used for the implementation of the invention, FIGS. 3 to 6 various examples of arrangement of the wires used as diffractors in the useful scattering cone, and FIG. 7, an illustration of the possible heating in the wires over time, FIG. 8, the timechart corresponding to the numerical application.

FIG. 1 shows diagrammatically an exemplary device according to the invention, composed of three parts.

A first part I consists of an electron gun which produces the electron beam which will be focused in a focusing device, part II, the focused beam being transmitted thereafter to the third part III which is composed of a set of wires arranged according to a layout which is dependent on the application envisaged, and in a cone of half-angle $1/\gamma$. The focusing device used must satisfy quality criteria so as initially to have a well contained electron beam.

Shown diagrammatically in this figure is a cone where the energy of the electrons can still be useful and beyond which is a zone where the electrons which could be recovered are not of sufficient benefit.

On the basis of an electron beam of good emittance $\epsilon$ and of high energy ($\gamma$), focused on a zone of $(\beta\epsilon/\gamma)^{0.5}$ where $\beta$ represents the contribution of the magnetic-focusing elements, at an angle $(\epsilon/\beta\gamma)^{0.5}$ For $\beta=0.1$, $\gamma=10$ (energy of 5 MeV), $\epsilon=10^{-6}$ m*rad, we obtain 100 μm and 1 mrad.

The parameters of the electron beam must be optimized by taking into account:

- The constraint of focusing on a small area (typically represented by the size of the wire situated at the vertex of the useful scattering cone)
- The constraint to maintain the electron beam substantially along the axis of the useful scattering cone
- The compromise must take into account:
- the capabilities for focusing the beam represented by the parameter $\beta$ represent the contribution of the magnetic-focusing elements
- the intrinsic quality of the electron beam, represented by the normalized emittance $\epsilon$
- The energy of the electrons, represented by the relativistic factor $\gamma$ In practice, focusing on a zone Z of size $(\beta\epsilon/\gamma)^{0.5}$ corresponds to an electron beam dispersed at an angle of $(\epsilon/\beta\gamma)^{0.5}$. These formulae show the benefit of having a beam with high energy and with good normalized emittance since the focusing and the directivity of the beam improve as $\gamma$ increases and $\epsilon$ decreases. Thus for $\beta=0.1$ m, $\gamma=10$ (energy of 5 MeV), $\epsilon=10^{-6}$ m*rad, we obtain respectively 100 μm and 1 mrad. This angle of arrival of the electrons at the useful scattering cone is much smaller than the characteristic scattering angle of the Bremsstrahlung (which is typically $1/\gamma$, i.e. 100 mrad).

These values are given by way of example and must be adapted as a function of the desired characteristics of the X-radiation.

According to one embodiment, the X-rays produced by the interaction between the electrons and the wires can thereafter be picked up in a solid angle retrievable by an optic of capillary type.

Figure 2:
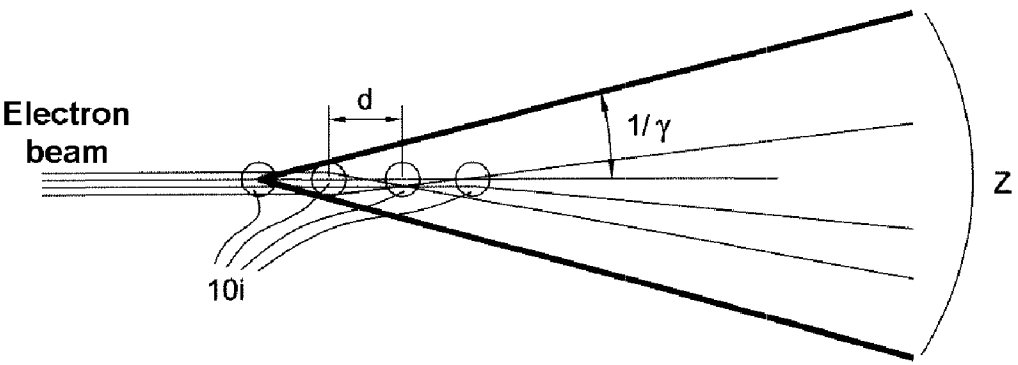

FIG. 2 details an exemplary layout of several wires spaced apart by an equal distance d, the figure showing the cross-section of the wires 10*i*, having a diameter D, a radius r. The value of the perimeter/area ratio of the cross-section of the wire will be chosen for good thermal dissipation. The distance d is also chosen to allow thermal dissipation by radiation.

It is assumed at the start that the electron gun and the focusing device have generated a quality beam, that is to say that the electrons are not too dispersed and that they are arranged rather around a directional axis.

An electron of the beam has a bigger probability of encountering at least one of the wires arranged in the scattering cone than if there is a single target.

An electron will therefore interact with one or more of the wires of the diffraction grid in the cone and the device according to the invention will make it possible to reuse electrons that have not interacted or have interacted little with the first wire and which thus remain in the scattering cone.

This interaction will produce a beam of X-rays having a quality that may be expressed in the form of a spectral brilliance.

Figure 3:
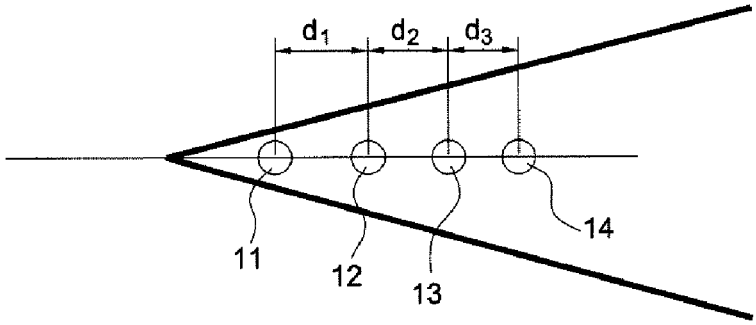

The value of the distance between two wires is also chosen as a function of the thermal heating resulting from the interaction of an electron with a wire. It may be chosen for example equal to the radius of the wire. It can also vary as a function of the position of the wire in the scattering cone in the case where the heat to be dissipated is lower on the last wires, as is indicated in FIG. 3. In FIG. 3 are represented several wires 11, 12, 13, 14 whose distance decreases in this exemplary embodiment with d1>d2>d3. The diameters of the wires 11, 12, 13, 14 need not be equal. The variation of the distances between wires, as well as the layout of their axes, also make it possible to reconstitute a virtual material whose mean density is adjustable inside the scattering cone. It is possible to contemplate for example a higher density on the axis of the scattering cone than at its periphery so as to optimize the X-radiation profile.

It is notably chosen as a function of the material of the wire. The wire used may be chosen from among the list of following materials: tungsten, carbon a few micrometres in diameter, etc.

The wires will be chosen from among materials having good mechanical properties (tension withstand, ductibility) and thermal properties (melting point, conductivity) as well as properties relating to the Bremsstrahlung (atomic number, density, emission spectral line K$\alpha$). Thus depending on the sought-after type of application, wires made of copper, carbon or tungsten will be favoured for example. A multiple association of materials both for the composition of a wire and for the association of wires of distinct materials can also be envisaged.

It should also be noted that the notion of wires may be broadened by employing liquid metal jet for example. The partial sublimation of the metal by a sufficiently intense beam of electrons can also be sought so as to produce a plasma in the scattering cone liable to favour the radiation of the K$\alpha$ spectral line to the detriment of the other parts of the spectrum, which are filtered by the plasma. It is then necessary to avoid the breakage of the wires, which may be obtained by adjusting the speed of movement of the wires for example so as to avoid excessive heating.

Figure 4:
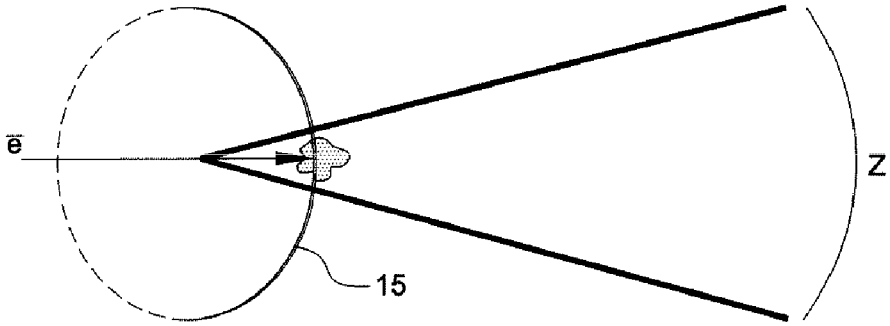

According to one embodiment, it is possible to use one or more wires 15 whose position with respect to the electron beam shifts over time, for example, according to a linear and/or circular motion. This embodiment thus allows a first electron to hit the wire at a first place or a first zone of the wire, and then at a zone adjacent to the first and so on and so forth. The electron following the first electron in the beam will hit the wire in a place of the wire different from the first (FIG. 4). The wire 15 is mounted on a support allowing its displacement with respect to the beam. This displacement shown diagrammatically as being circular in FIG. 4 can, without departing from the scope of the invention, be linear or follow any other motion compatible with the sought-after effect, namely that the electrons of the beam do not interact with one and the same part of the wire or in one and the same place.

In the case of the presence of several wires in the zone the movements of the wires are in opposite directions for two collinear and contiguous wires.

Figure 5:
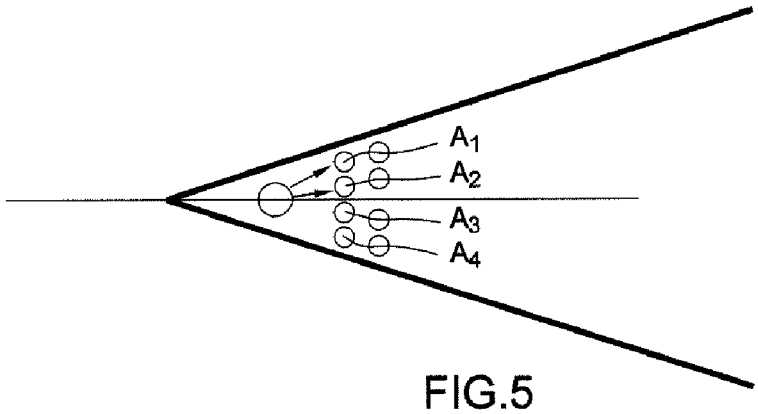

According to another embodiment, FIG. 5, it is also possible to arrange several rows of wire in the scattering cone, along various axes Ai which are mutually parallel. The diameters of the wires can optionally have different cross-section values according to their positioning in the scattering cone. This type of setup, coupled with a suitable movement of the wires, makes it possible to improve the cooling of the wires by radiation.

Figure 6:
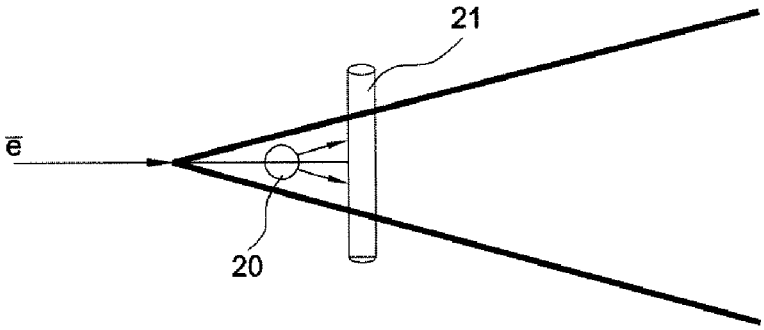

The wires 20, 21 may be arranged perpendicularly pairwise as indicated in FIG. 6.

Figure 7:
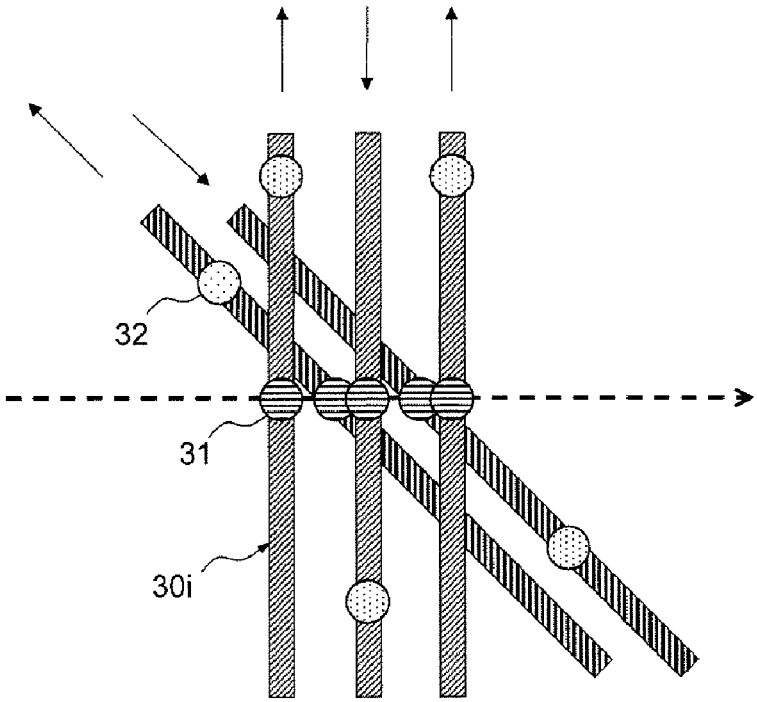

FIG. 7 shows diagrammatically a representation of the heating of the wires over time. Thus, the dot referenced 31 corresponds to a heating at the instant t (strong concentration making cooling by radiation difficult), the dots referenced 32 to a heating at the instant t+1: Strong dispersion of the hot spots allowing better cooling. The wires 30*i* have a high density in the zone of interaction with the electrons but lower outside: the losses by thermal radiation therefore make it possible to cool the wires better than if all the wires were collinear.

Figure 8:
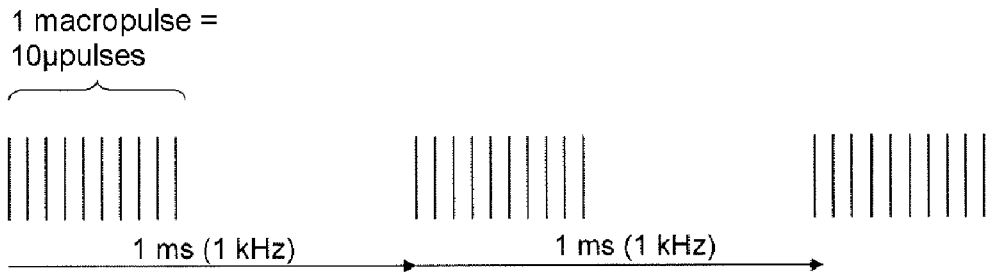

In order to better illustrate the principle used for the implementation of the method and of the device according to the invention, a numerical example will now be given. The corresponding timechart is shown diagrammatically in FIG. 8.

By way of example we take a beam of electrons providing 10 micro pulses of 1 nC each at the rate of 1000 Hz at an energy of 5 MeV. The mean power of the electron beam is therefore 50 W. Let us assume that this beam interacts with some hundred 10-μm wires located on the axis of the scattering cone. 22 W are then lost by collision and 10 W are radiated in the form of X-radiation. The movement of the wires at a speed of 1 m/s allows a displacement of one mm of the wire between macro pulses, much greater than the zone irradiated in the course of the macro pulse. In practice, each of the wires must remove a power of only 220 mW (making the assumption of identical energy deposition on each of the wires).

The invention may be used in certain cases to obtain a significant mean flux related to the gun with several thousands of micro pulses in a macro pulse which may itself possibly be repeated at several tens of Hz.

The device according to the invention exhibits notably the advantage of providing an X-radiation source having at one and the same time a great deal of power and a very directional source with a high brilliance.

The device makes it possible notably to obtain a very small size of focus related to the emittance and to the energy of the electron beam, a directivity by simple diffraction or "single scattering" corresponding to a $1/\gamma$ half-cone where $\gamma$ is the relativistic factor.

The invention claimed is:

1. A compact device for generating X-rays by scattering, the device comprising:

a means for producing a beam of electrons, and a grid of wires, said grid being arranged in a scattering cone, so that the electrons of the said beam encounter at least one of the wires of the grid and produce X-radiation after interaction with the grid material.

2. The device according to claim 1, wherein the grid consists of a set of wires arranged along an axis A1 and which are regularly distributed and spaced one and the same distance d apart on the said axis.

3. The device according to claim 1, wherein the scattering cone comprises several rows of wire which are arranged along several axes A1 . . . An.

4. The device according to claim 1, wherein the cross-section of the wires is variable.

5. The device according to claim 1, wherein the wires are spaced apart by distances d1, d2, d3 whose values are decreasing.

6. The device according to claim 1, wherein the wires are mounted on supports allowing them to move so that an electron of the beam of electrons interacts with a different cross-section of the wire from the cross-section with which the temporally previous electron of the beam has interacted.

7. The device according to claim 6, wherein the movements of the wires are in opposite directions for two collinear and contiguous wires.

8. The device according to claim 1, wherein the wire is made of a material chosen from among the following list: tungsten, copper, carbon, metal jet, microballs, or is formed partially by a plasma of the materials so as to form a monochromatic filter.

9. The device according to claim 1, further comprising:

a retrieving optic arranged at the exit of the cross-section of interaction of the electrons with a wire so as to increase the directivity of the beam.

* * * * *

UNITED STATES PATENT AND TRADEMARK OFFICE

CERTIFICATE OF CORRECTION

PATENT NO. : 8,391,443 B2
APPLICATION NO. : 12/975135
DATED : March 5, 2013
INVENTOR(S) : Jean-Pierre Brasile It is certified that error appears in the above-identified patent and that said Letters Patent is hereby corrected as shown below:

Title Page, Item (54) and in the Specification, Column 1, line 1, Title:

Replace "COMPAC" with --COMPACT--.

Signed and Sealed this
Eleventh Day of March, 2014

Michelle K. Lee

Michelle K. Lee
*Deputy Director of the United States Patent and Trademark Office*